United States Patent [19]

Rusche

[11] 4,311,416

[45] Jan. 19, 1982

[54] PRE-LOAD JACK SYSTEM AND METHOD OF DRIVING ELEMENT INTO THE GROUND

[76] Inventor: Fredric Rusche, 30303 Beck Rd., Wixom, Mich. 48096

[21] Appl. No.: 92,442

[22] Filed: Nov. 7, 1979

[51] Int. Cl.[3] ..... E02D 7/06; E02D 7/20

[52] U.S. Cl. ..... 405/232; 173/1; 173/46; 173/23; 254/29 R

[58] Field of Search ..... 405/232, 241, 242, 243; 175/19, 56, 162, 20–23; 173/4, 22, 23, 27, 28, 112, 147, 1, 29, 46; 254/29, 93 VA

[56] References Cited

U.S. PATENT DOCUMENTS

| | | | |
|---|---|---|---|
| 337,119 | 3/1886 | Bigelow | 173/46 X |
| 2,209,660 | 7/1940 | Oka | 254/29 R |
| 2,711,880 | 6/1955 | McKenzie | 173/147 X |
| 3,198,263 | 8/1965 | Reischl | 173/26 |
| 3,204,534 | 9/1965 | Spannhake | 173/112 X |
| 3,696,625 | 10/1972 | Alexander | 173/46 X |
| 3,734,202 | 5/1973 | Gyongyosi | 173/4 |
| 3,846,991 | 11/1974 | Wisotsky | 173/1 X |
| 3,847,230 | 11/1974 | Blomquist | 405/232 X |

*Primary Examiner*—Ernest R. Purser
*Attorney, Agent, or Firm*—Littlepage & Webner

[57] ABSTRACT

A pile driving rig is used to pre-drill a hole into which an elongate element, such as a pile or a hollow mandrel is inserted. A large portion of the weight of the rig is imposed upon the elongate element by a jack system, one part of which rests upon the pile element and the other part of which jacks up one end of the rig. If further seating of the pile is desired the jacking force is momentarily released so as to drop the superimposed weight of the rig onto the elongate element.

8 Claims, 20 Drawing Figures

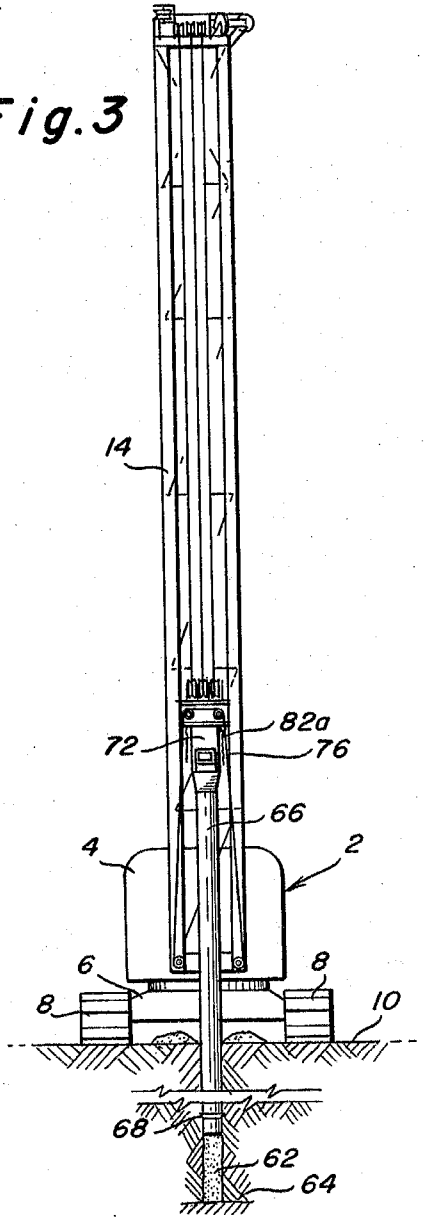
Fig. 3
14
72
82a
76
66
2
4
6
8
10
62
64
68
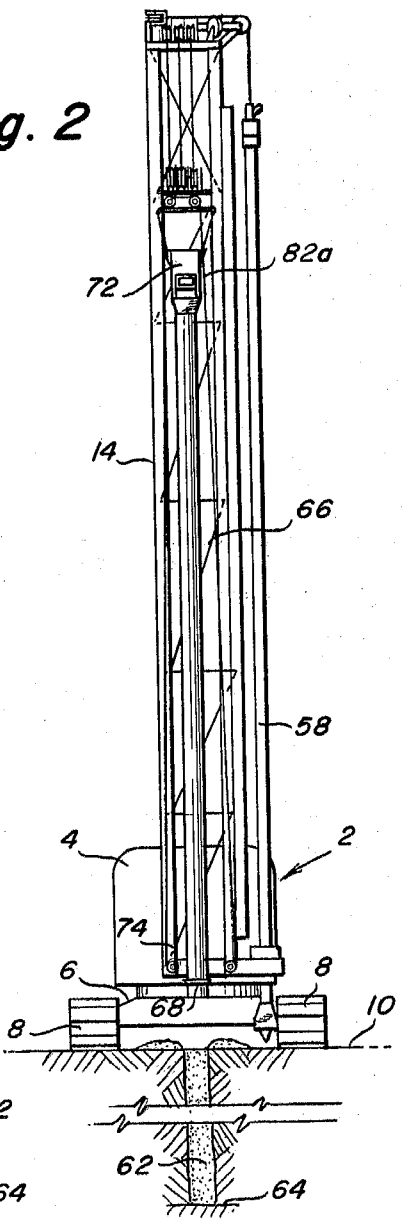
Fig. 2
72
82a
14
66
58
2
4
6
8
10
68
74
62
64
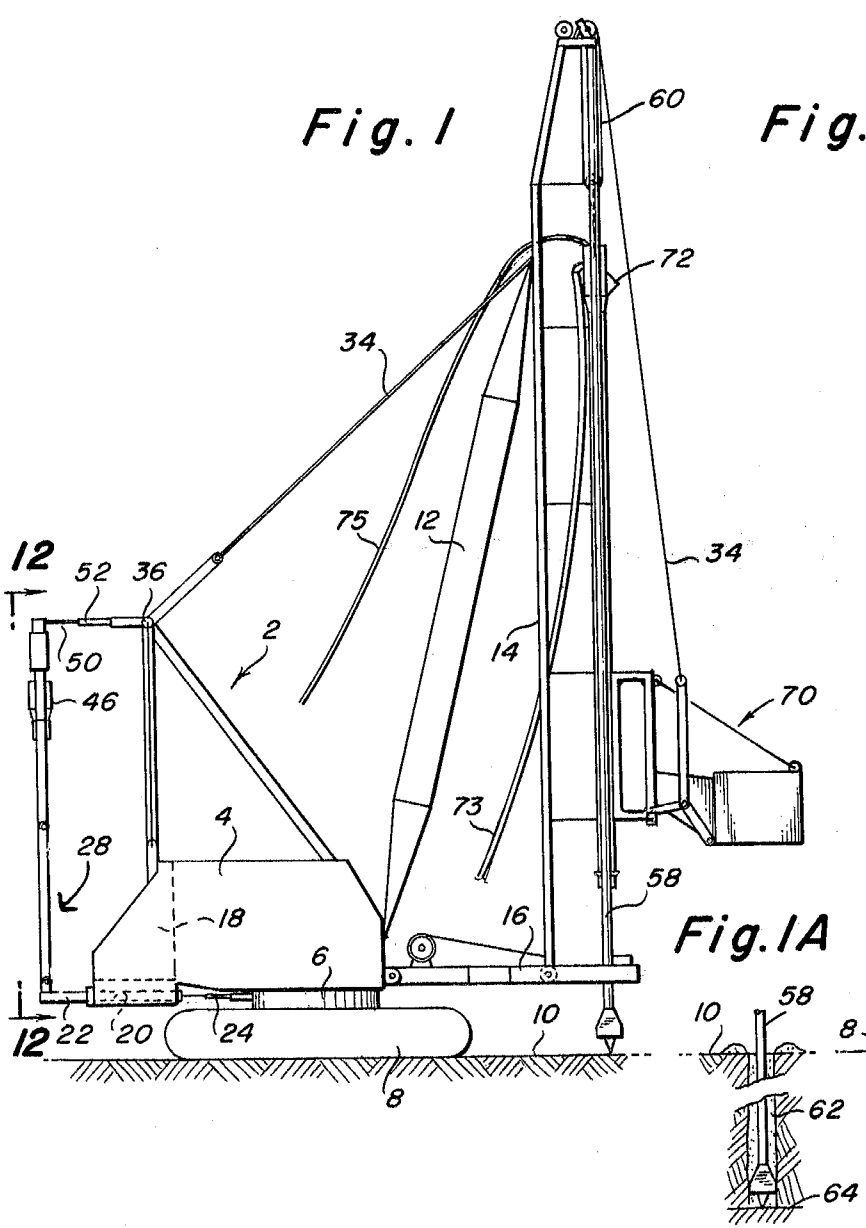
Fig. 1
60
72
34
70
14
12
75
73
16
58
10
8
6
2
4
18
24
20
22
36
52
50
46
28
12
12
Fig. 1A
58
10
62
64

70
34
12
52
50
36
31
72
14
2
4
28
26
18
16
24
6
22
20
10
8
66
68
64

34
12
14
70
10
66
68
64

70
34
12
52
50
36
72
31
2
4
26
28
18
16
20
22
8
6
10
66
64
68

2
12
14
70
72
16
10
64
68

2
12
14
72
75
73
70
16
10
64
68

75
12
72
70
73
2
14
16
10
64
68

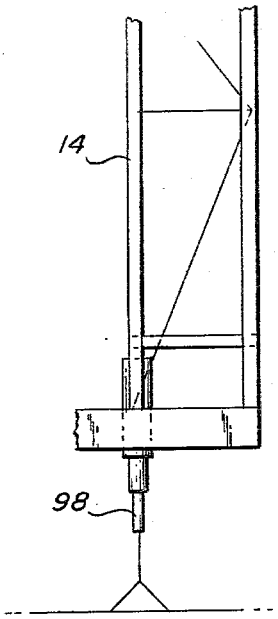
Fig. 15
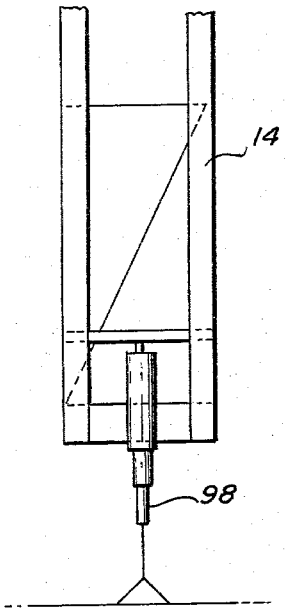
Fig. 16
Fig. 11

PRE-LOAD JACK SYSTEM AND METHOD OF DRIVING ELEMENT INTO THE GROUND

RELATED APPLICATION

Rusche Ser. No. 915,456 filed June 14, 1978 and now abandoned for IN SITU PILE FORMING METHOD AND APPARATUS, a division of Ser. No. 832,947 filed Sept. 13, 1977 now U.S. Pat. No. 4,158,518.

FIELD OF INVENTION

Hydraulic and Earth Engineering, Foundation, Columnar Structure, Process or Apparatus for Installing.

PRIOR ART

U.S. Pat. Nos: Rios et al. 2,656,684; Dentz et al. 2,822,671; Landau 3,303,656; Rusche 4,158,518.

OBJECTS

The primary object of this invention is to provide for firmly seating a pile element such as a hollow mandrel or a pile into a bearing strata without using a hammer. Not only are hammers expensive to obtain and use, but there are certain types of pile elements which heavy blows from a hammer would damage, such as a mandrel with a hopper and sheaves on its top. Also, there are many environments, such as the neighborhood of a hospital or a business office, where the noise of a pile driver hammer cannot be tolerated.

Ordinarily, when a pile or a mandrel is installed into the ground without using a hammer, an auger is used to pre-drill a hole, and thereafter the pile element installation may proceed in one of several ways. Sometimes the pile itself may be inserted into the hole. Other times, a hollow mandrel may be inserted into the hole and concrete is poured or forced into the hole through the mandrel as the latter is withdrawn.

In the above-described cases, the mandrel or the augered hole defines the size and depth dimensions and the location of the cavity which is to contain the casingless pile. Oftentimes when piles are installed without using a hammer, a suitable pile is not obtained because the pile tip does not rest in suitable material. Unless a reliable soil boring is available immediately adjacent the pile location, the soil can, and often does, vary greatly from footing to footing. The result is that the pile tip often does not rest in good bearing material.

The primary object of this invention is to provide for installing an elongate element, be it a pile or a mandrel, with assurance that its lower end is seated firmly in good bearing strata. To this end it is proposed now to use a large portion of the weight of the rig to provide a reaction force against which the inserted mandrel or pile can be jacked. Not only is it intended to utilize the static load imposed on the inserted element by the rig as a reactive force against which the pile element is jacked, but also to impose thereon a dynamic force resulting from dropping the jacked-up rig towards the inserted element and then suddenly stopping the dropping motion of the rig. It has been calculated that that this latter force can be about three times that of the static weight of the rig. With conventionally sized rigs now used in pile driving, pre-loads from 100 to 200 tons can be developed.

In a typical pile driving rig, leads are mounted on the front end of a crane, such as a #3900 Manitowoc, and a heavy counterweight is installed in the rear of the machine to prevent the rig from tipping forwardly when a heavy load is picked up. One of the objects of this invention is to provide, in a rig of the above-described type, a jacking assembly mounted on the rear end of the crane so that the weight of the counterweight serves not only as a reactive force against which the pile is jacked, but also as a dynamic force when the rear end of the crane is dropped for short distances and suddenly stopped in its dropping motion.

In another form of the invention, the weight of the front portion of the crane and the components thereon, including the boom, leads, auger, and concrete skip, are used for both the static and dynamic reactive forces against which the pile element is jacked.

In short, instead of using hammer blows to seat the pile element home into a bearing strata, one end of the entire rig is jacked up and imposed on it.

These and other objects will be apparent in the following specification and drawings, in which:

FIG. 1 is a side elevation of a pile driving rig with a jack system on the rear end of the crane, and with an auger mounted in the leads on the front end of the rig;

FIG. 1*a* illustrates the lower portion of the auger which has been driven down to or just short of a bearing strata;

FIG. 2 is a front elevation of the rig shown in FIG. 1, with the auger removed from the drilled hole;

FIG. 3 is a view similar to FIG. 2, but illustrating a hollow mandrel being installed into the drilled hole;

Figure 4:
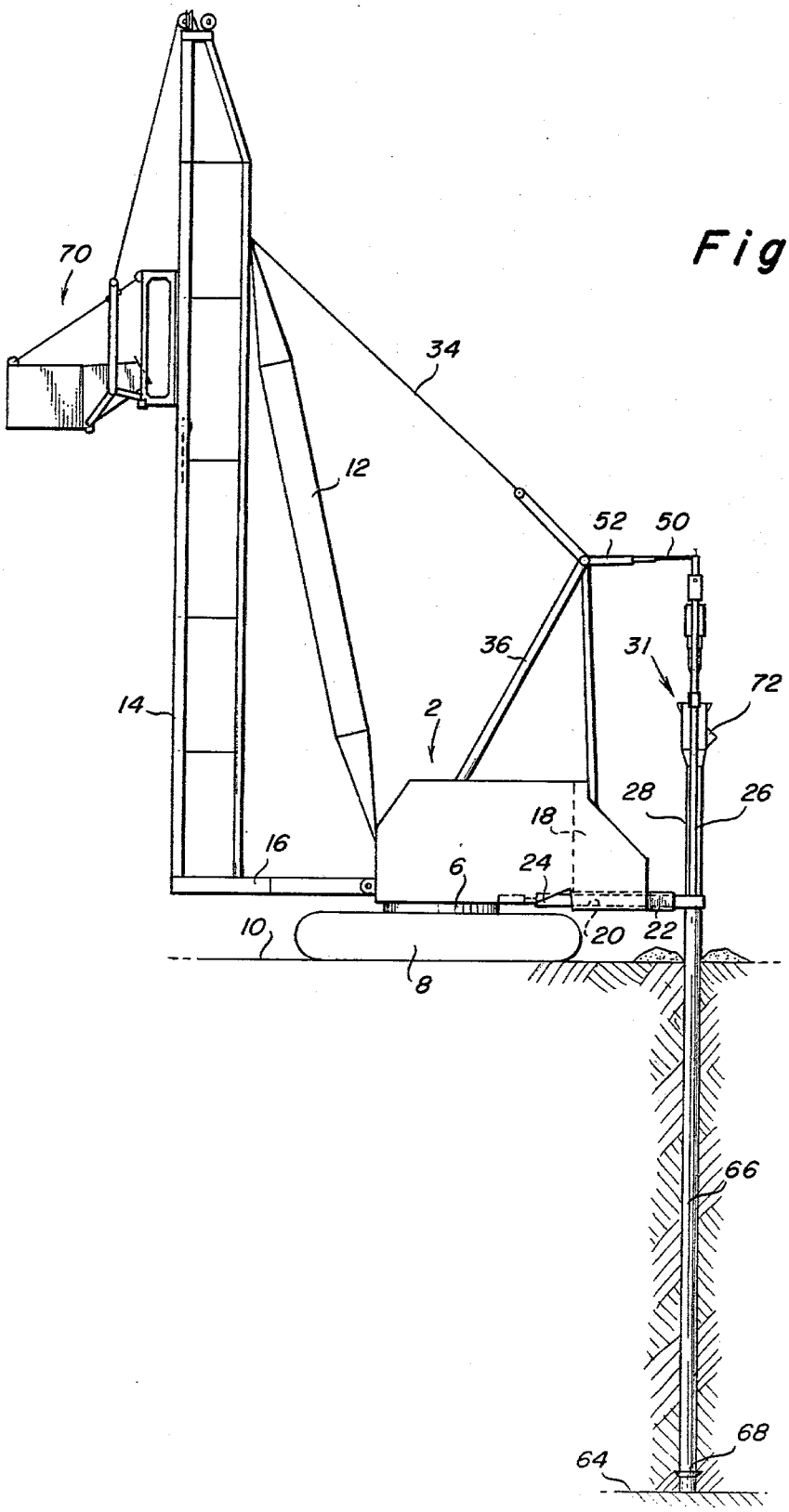
FIG. 4 is a side elevation of the rig reversed from its FIG. 1–FIG. 3 position and with the jacking assembly engaged on the upper portion of the inserted mandrel.
Figure 4A:
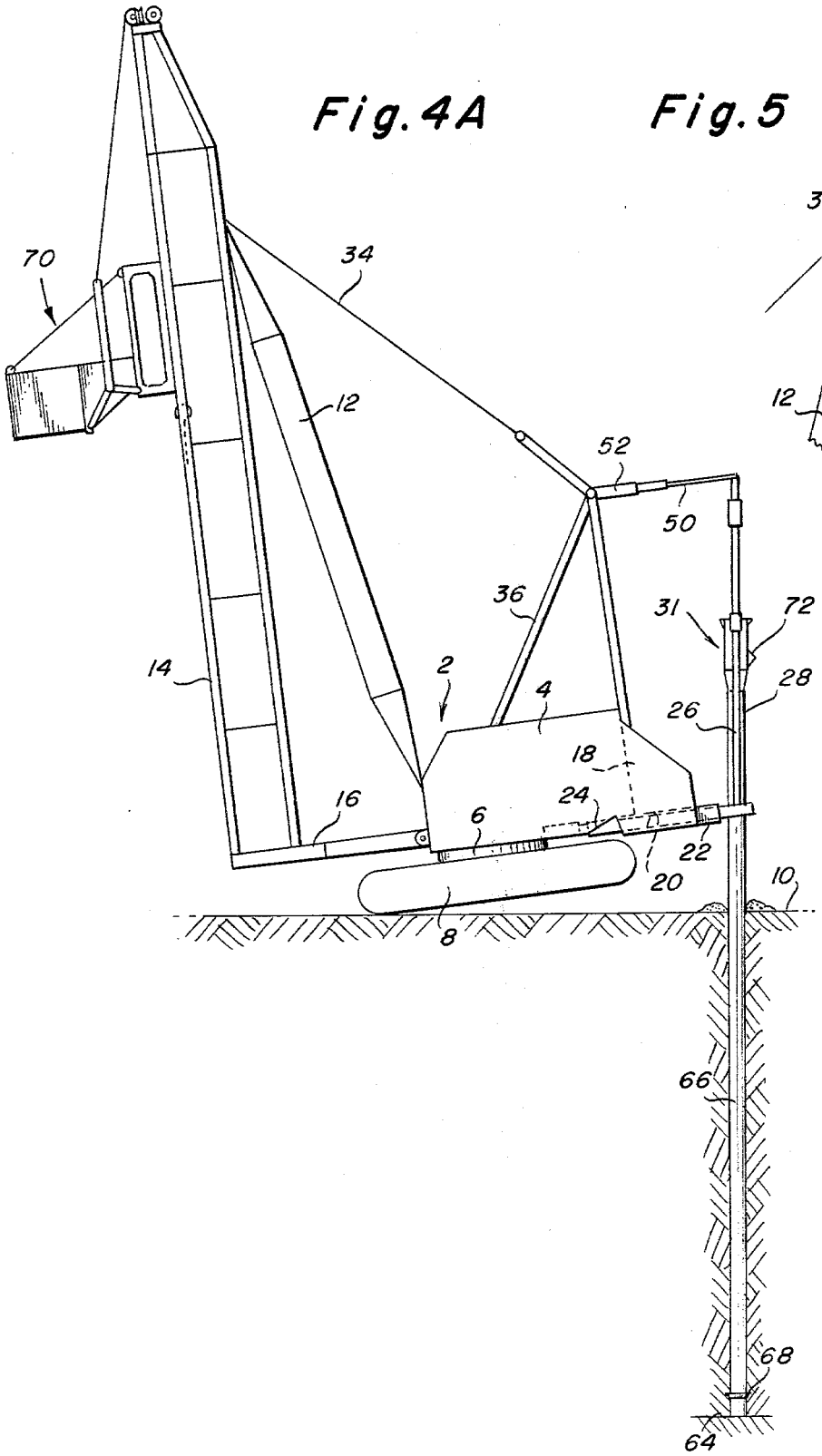
Figure 5:
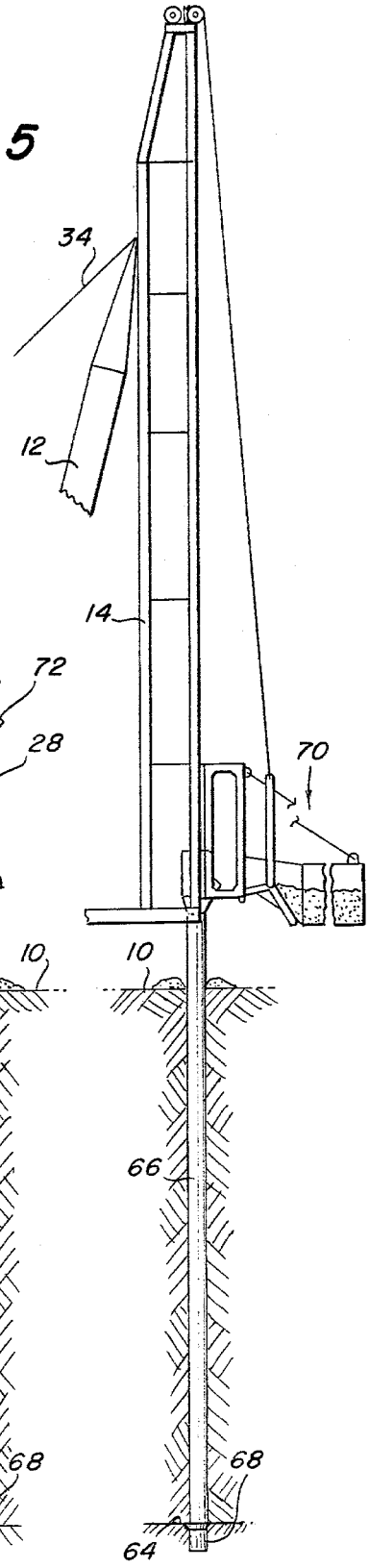
Figure 4B:
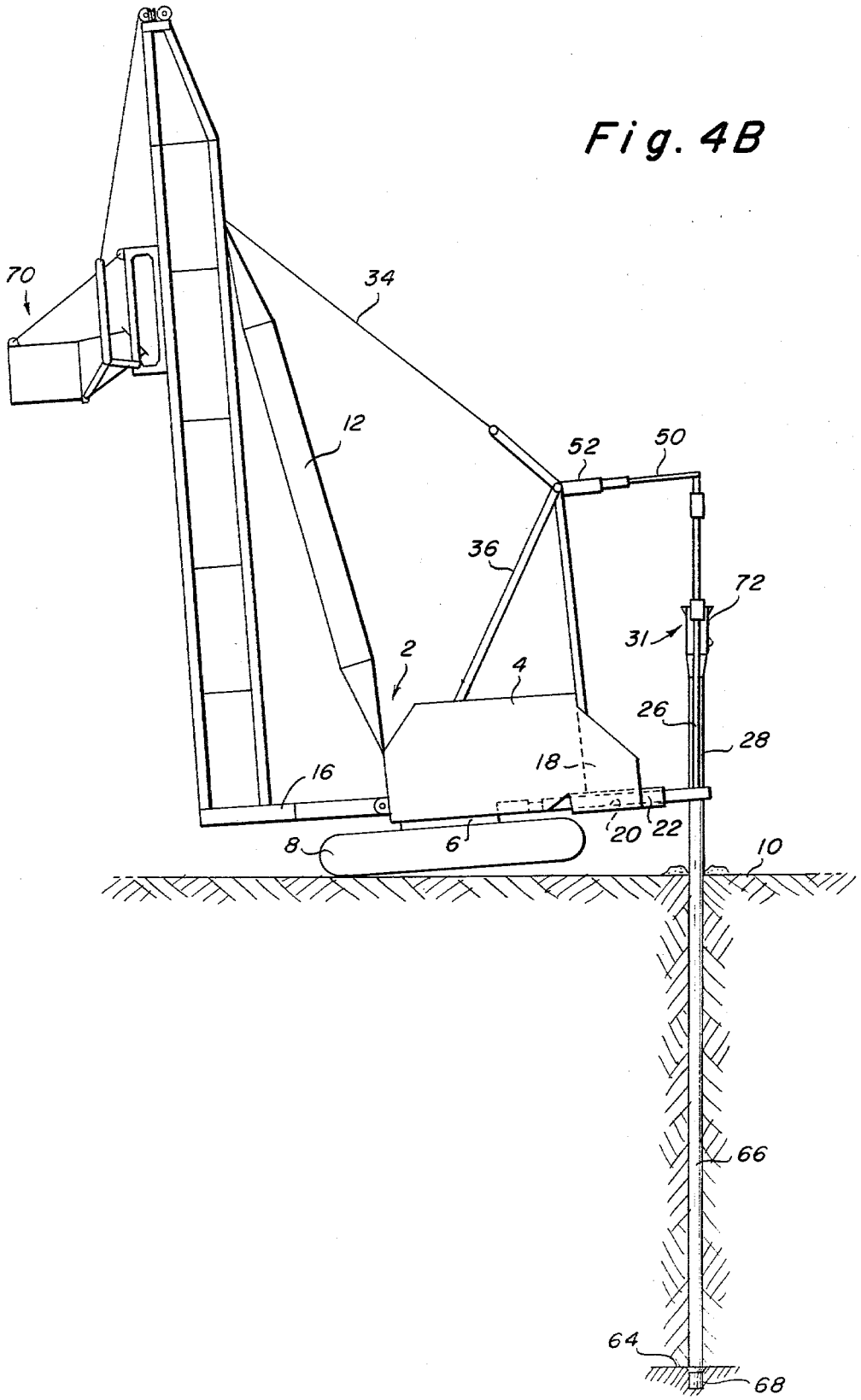
Figure 6:
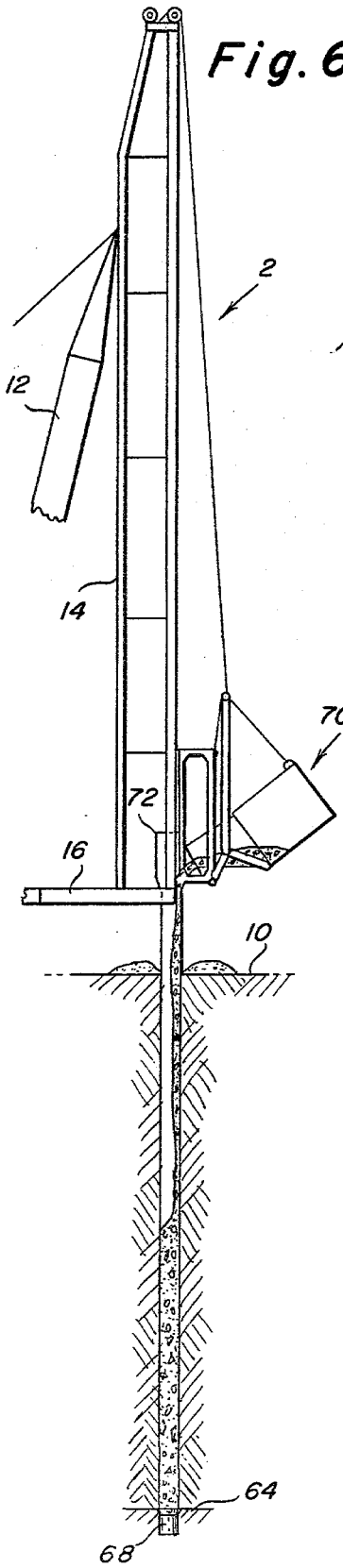
Figure 7:
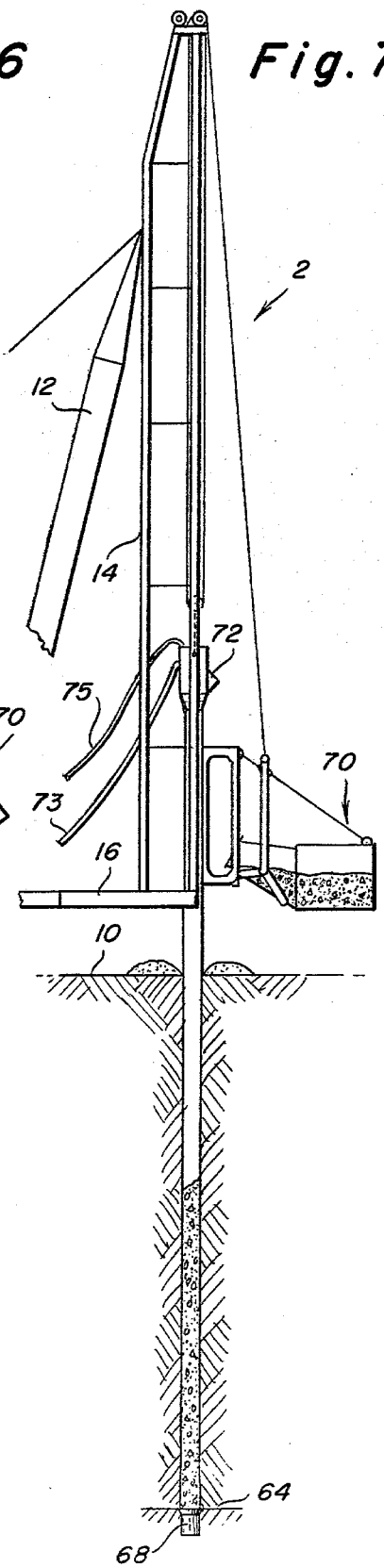
Figure 8:
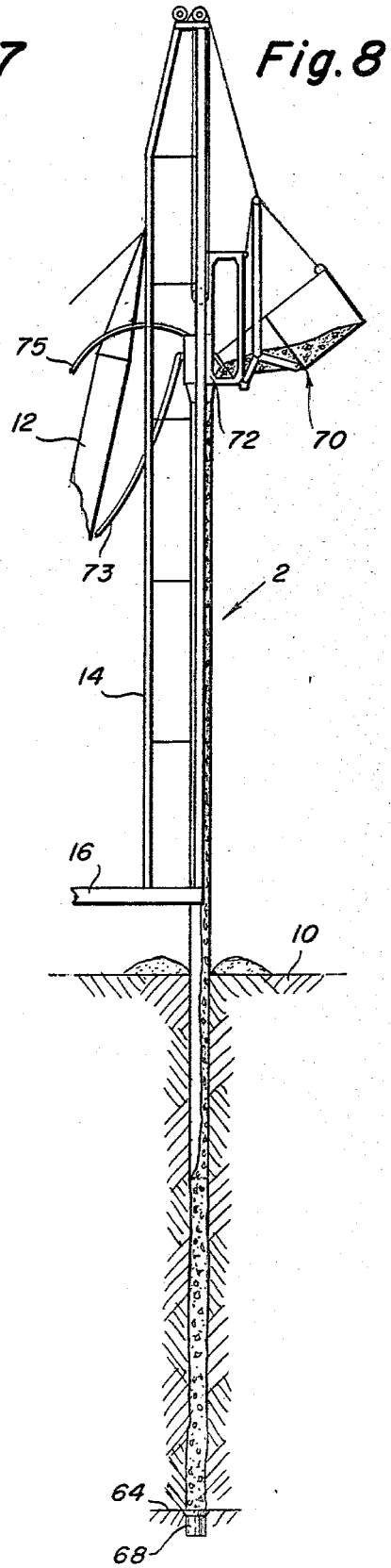
Figure 9:
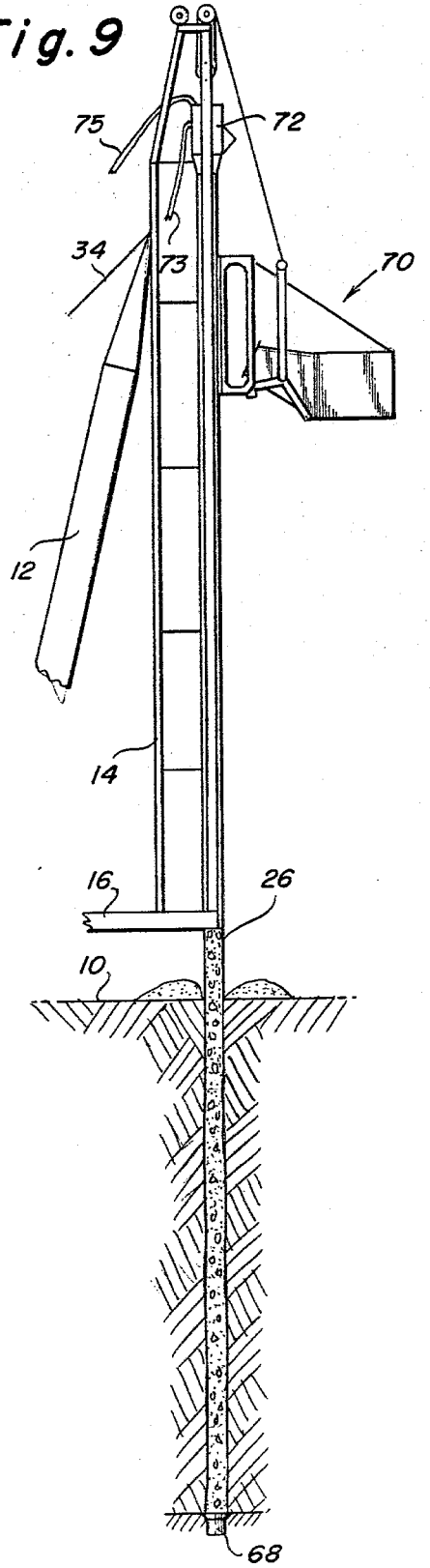
Figure 10:
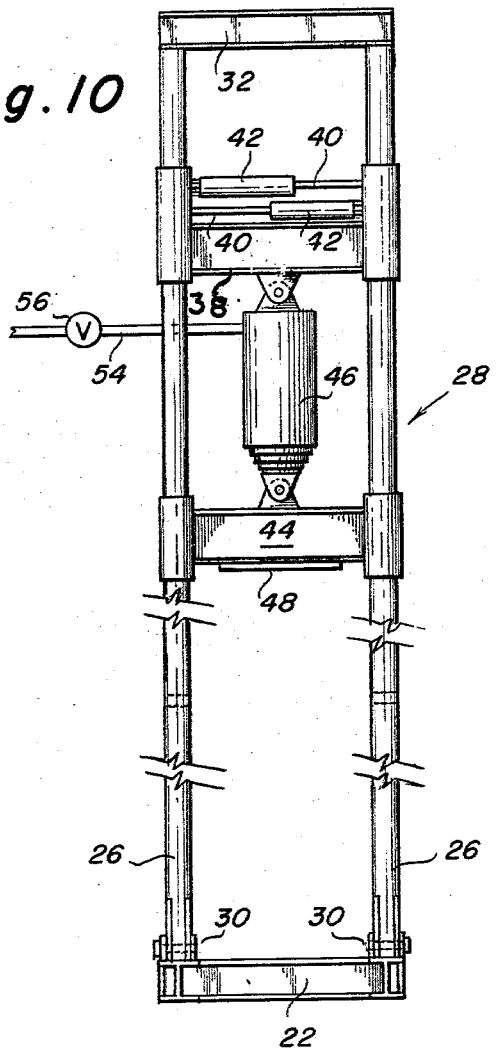
Figure 14:
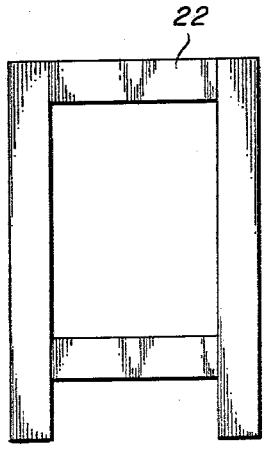
Figure 11A:
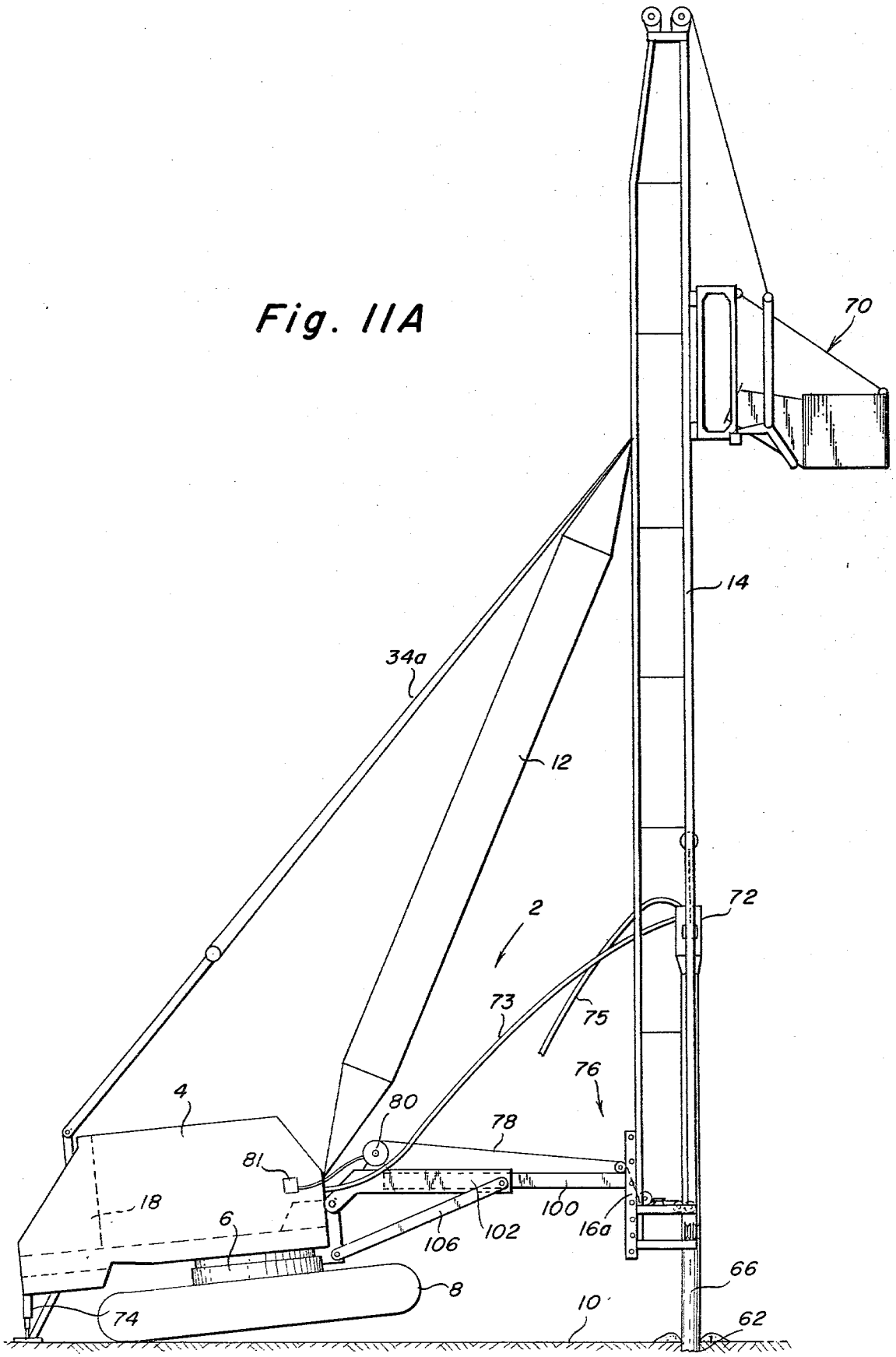
Figure 12:
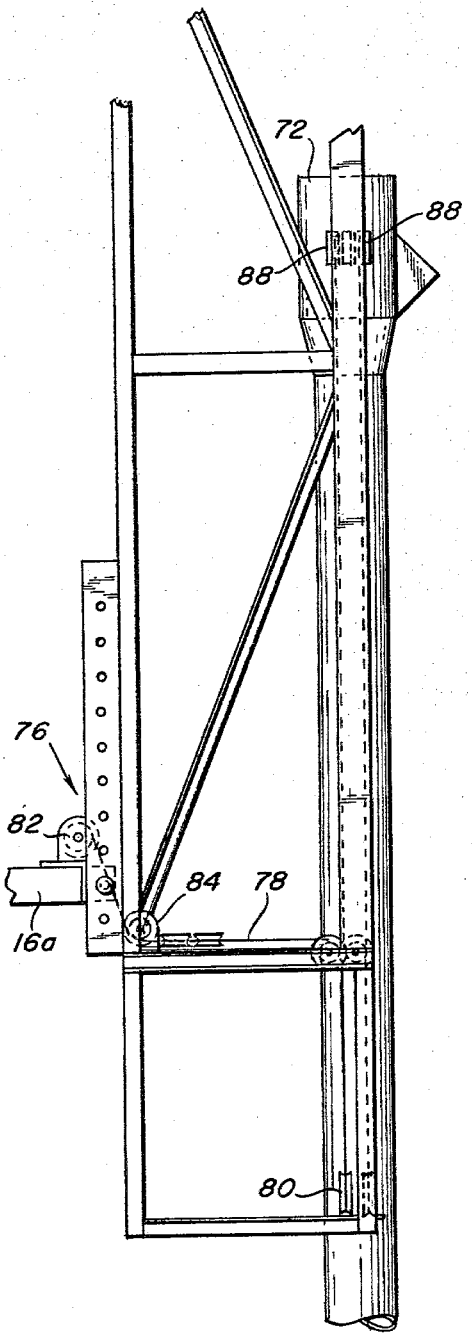
Figure 13:
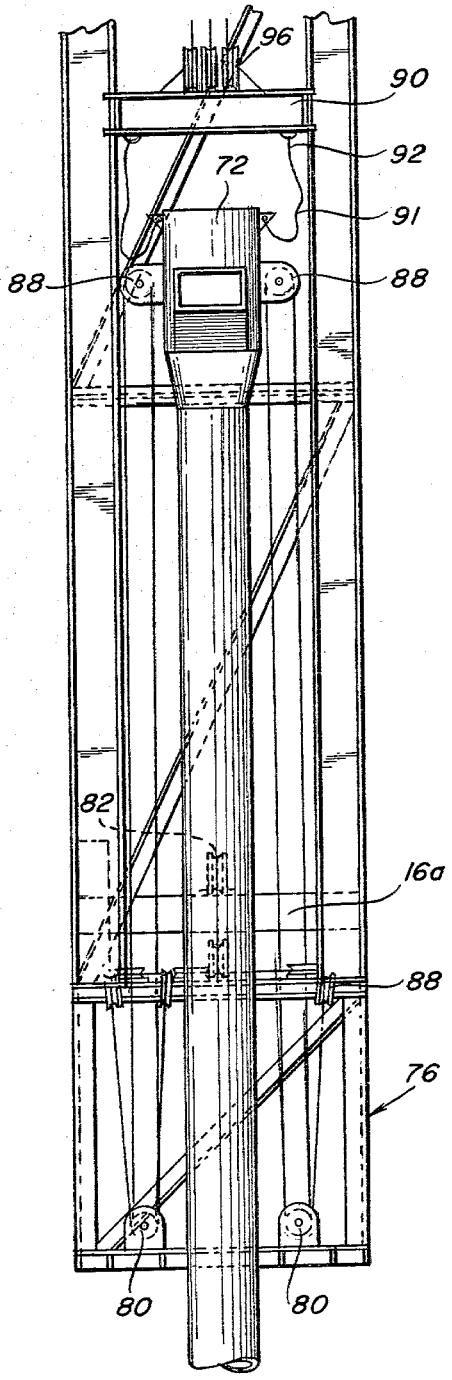

FIG. 4*a* is a view similar to FIG. 4, but showing the rear of the crane jacked up so as to impose the force of its static load upon the mandrel;

FIG. 4*b* is a view similar to FIG. 4*a*, but showing the rear portion of the crane having been dropped for a short distance so as to impose the force of its dynamic load upon the pile element;

FIG. 5 is a fragmentary side elevation wherein the crane has been returned to its FIG. 1–FIG. 3 position, and showing the commencement of the concrete mortar pouring operations;

FIGS. 6, 7, 8 and 9 are fragmentary side elevations of the front end of the rig, illustrating the further successive steps of the concrete mortar pouring operation and mandrel-lifting;

FIG. 10 is a rear elevation of the jacking assembly which is attached to the rear end of the crane;

FIG. 11 is a side elevation of a pile driving rig with a mandrel insstalled and jacked down, utilizing the static load of the front end of the rig;

FIG. 11*a* is a view similar to FIG. 11, but showing the front end of the rig jacked up and about to be dropped upon the pile;

FIG. 12 is a fragmentary side elevation illustrating the jacking assembly used with the rig operated in the FIG. 11 and FIG. 11*a* mode;

FIG. 13 is a fragmentary front elevation of the jacking assembly shown in FIG. 12;

FIG. 14 is a plan view of the sliding bottom frame for the jacking rig used in the FIG. 1–FIG. 4*b* mode;

FIG. 15 is a diagrammatic side elevation showing a hydraulic jack foot for the leads; and FIG. 16 is a diagrammatic front elevation of the hydraulic jack foot shown in FIG. 15.

Referring first to FIGS. 1–4*b* and FIG. 10, the apparatus and method wherein the weight of the rear end of the rig is used for inserting the pile element will first be described. The rig 2 is comprised of a conventional crane 4 having a chasis 6 and crawlers 8 by which the crane is moved along the ground 10. On the forward end of the crane is a boom 12 which supports leads whose lower ends are mounted on an extensible-retractable spotter 16. A counterweight 18 diagrammatically illustrated by dash lines is mounted in the rear end of the crane 4. The counterweight is normally used for balancing the crane against tipping forwardly when boom 12 is lowered and a heavy load is picked up.

According to this invention, a slide-way 20 is mounted in the lower rear portion of the crane, in which a frame 22 (FIG. 14) is slidably mounted for extension and retraction by a hydraulic jack 24. The frame may be likened to a drawer. The uprights 26 (FIG. 10) of a jacking frame 28 are connected by pins 30 to the projecting outer ends of frame 22. Jacking frame 28 further includes a rigid top cross member 32 which is adjustably supported from the crane rigging 34 and gantry 36 as described hereinafter. Below the fixed top cross member 32 is a vertically adjustable crosshead 38 which is maintained in adjusted position by locks 40 operated by hydraulic jacks 42. Beneath the vertically adjustable cross head 38 is a sliding crosshead 44 which is actuated by hydraulic jack 46, and which has on its lower side a plate 48 which rests on the top of the pile element to be jacked into the ground. Jack 46 is actuated by pressure fluid diagrammatically illustrated by the fluid line 54 and controlled by valve system diagrammatically illustrated at 56. It will be understood that the valve system 56 may be actuated so as to supply pressure fluid to jack 46 or, alternatively, to momentarily release the pressure fluid. The upper end of jacking frame 28 may be let out or pulled in by means of a rod 50 actuated by a hydraulic jack 52 connected to the crane rigging 34 at the upper end of gantry 36.

FIGS. 1–3 illustrate conventional preliminary steps for installing a pile element which, in the illustrated embodiment, is a hollow mandrel 66. An auger 58 suspended as at 60 from the upper end of leads 14 is driven in conventional manner so as to drill out a hole 62. As is frequently the case, the lower end of the auger may or may not satisfactorily penetrated into the bearing strata 64 at the lower end of the hole. The auger 58 is then withdrawn from hole 62 and a hollow mandrel 66, preferably having a removable boot 68 on its lower end, is suspended over the hole (FIG. 2) and lowered down into the hole (FIG. 3). If the mandrel hangs up during its lowering it may be inserted further by operation of a pull down rigging. The object at this point is to get the mandrel 66 down far enough so that the plate 48 of the jacking assembly 31 on the rear of the crane can be engaged onto the top of the hopper 72 on the upper end of mandrel 66.

Referring now to FIGS. 4, 4*a* and 4*b* it will be seen that the rig has been reversed from its FIGS. 1–FIG. 3 position and the plate 48 (FIG. 10) has been engaged on top of the hopper 72. Pressure fluid is fed to jack 46 so that the latter forces the mandrel downwardly until its lower end reaches or nears the bearing strata 64. During this operation, the cross head 38 of the jacking assembly 31 may be adjusted downwardly so as to take several "bites" at the jacking-down procedure. Ordinarily, after having been jacked down for a certain distance (depending on soil condition) the element reaches a point of refusal. At this point, the reactive force provided by the static weight of the crane is not enough to drive the element further into the ground, but this does not necessarily mean that the lower end of the element is at rest in a good bearing strata. Further actuation of the jacking-down procedure is continued until the rear end of the crane has been lifted above the ground (FIG. 4*a*). At this point the weight of the entire rear end of the rig is imposed upon the upper end of the mandrel.

If the load bearing capacity of the pile is insufficient and additional seating is needed, it will be so seated when the next operation is performed. This is as follows:

Valve 56 is momentarily opened so as to release pressure fluid from jack 46 and then the valve is immediately closed. This drops the load of the entire rear end of the crane, including counterweight 18 upon the upper end of the pile element, thereby seating its tip end into the bearing strata. If desired, in order to increase the imposed weight, a hydraulic foot 98 (FIGS. 15 and 16) may be used to take the weight of the leads 14 and boom 12 off the front portion of the crane and thereby prevent this weight from effectively countering the weight of the counterweight 18.

Still assuming that the pile element is a hollow mandrel, the pile may be formed in situ by pouring or forcing concrete down the mandrel into the hole as the mandrel is withdrawn. This process may be as described in my U.S. Pat. No. 4,158,518, preferably with certain improvements described below. They entail swinging the rig whereupon back around to its FIG. 1–FIG. 3 position and concrete from a skip 70 is poured into the hopper 72 on the upper end of mandrel 66. After the lower end of the mandrel has been filled with concrete, the mandrel is then lifted up (FIG. 7), so as to leave the over boot 68 embedded in bearing strata 64. As the mandrel 66 is lifted upwardly from position-to-position, the skip 70 follows the hopper 72 upwardly until the concrete pouring has been completed and the mandrel lifted entirely out of the hole. The concrete is forced downwardly and the mandrel lifted upwardly by closing hopper 72 and injecting air into the upper end of the mandrel by compressed air line 73. This process differs from that described in prior patent (supra) as follows: as the mandrel ascends so that its lower end is at or near the level of the ground, a vacuum is applied to the hopper 72 via a vacuum line 75. This holds the concrete remaining in the lower end of the mandrel 26 and prevents it from dumping out onto the ground. This remaining concrete can be used for the next pile or returned to the concrete supply truck. The foregoing process and apparatus may be used for in situ pile forming where concrete is forced into the hole via a hollow auger which is withdrawn as the concrete is forced into the hole below its tip. In this mode, it is equally important that the lower or tip end of the auger reach a good bearing strata before the concrete is injected. Another innovation in the pile forming process is that a pull-down ring is attached to the hopper in order to prevent the skip from lifting the mandrel when it engages the hook on the underside of the hopper mouth. When a hammer was used to seat the mandrel home into a good bearing strata, lifting the mandrel as a result of the impact and upward pull of the skip by resting the hammer on the top of the hopper. However, without the weight of the hammer, other means must be used to prevent undesired lifting of the mandrel. Other methods for forming the pile may be used.

Instead of seating the pile element home into the bearing strata by the method and apparatus described in connection with FIGS. 4, 4*a* and 4*b*, the front end of the rig may be dropped onto the pile element by the method and apparatus shown in FIGS. 11, 11*a*, 12 and 13. In this case, the mandrel 66 is lowered into the hole 62 in conventional fashion and preferably a hydraulic foot 74 is used to prevent the rear end of the crane from tipping downwardly. Thereafter, a pull-down cable rig 76 is actuated so that cables 78 running from a winch 80 over pull-down sheaves 82, 84, 86 and 88 are operated so as to jack the mandrel down into the hole. This down-jacking may continue until the entire front end of the rig assembly is lifted off the ground, as illustrated in FIG. 11*a*. Thereafter, winch 80 is suddenly let off by a control diagramatically indicated at 81 (FIG. 11*a*) and immediately thereafter braked so as to drop the weight of the entire front end assembly onto the hopper 72.

In the embodiment shown in FIGS. 11 and 11*a*, the spotter 16*a* is rigidly mounted on the end of a ram 100 which telescopes in a cylinder 102. This may be the cylinder element of a hydraulic jack, not shown, which is used for extending and retracting the ram. Ordinarily, leads, such as leads 14, are attached to the crane so that they may tip or point with respect to the crane, In this case, however, cylinder 102 is supported by a brace 106 so that the leads cannot tip. Thus, the total of the entire front end of the rig serves as a counter to the jacking-down force imposed on the mandrel, and the resultant dynamic force thereof is imposed on the mandrel when the winch 80 is momentarily let off.

I claim:

1. The method of forcing an elongate element into the ground with a machine having opposite end portions whose weights in the normal position of repose normally rest upon the ground surface, which method comprises; forcing the element endwise downwardly into the ground by applying down-jacking forces between a member on the first end portion of the machine and the element upon which element the member is drivingly connected, until upwardly reacting forces lift said first end portion upwardly from its normal position of repose and so that at least a portion of the weight of the said one end portion rests upon the element while the other end portion remains at rest on the ground; and then forcing the element further into the ground by first disestablishing the driving connection between the member on the first end portion and the element and then re-establishing said driving connection before said one end portion reaches its normal position of repose on the ground so as to drop said portion of the weight of said first end portion onto the element.

2. The method claimed in claim 1 wherein the member by which the downjacking forces are applied is a hydraulic pressurefluid jack and the driving connection between the member and the element is disestablished and established by opening and closing a pressure-fluid supply conduit to the jack.

3. In the method claimed in claim 1, the step of predrilling a hole into the ground, the element being inserted into the hole prior to the application of the jacking force.

4. The method of driving a pile into the ground, comprising drilling a hole into the ground, lowering a pile into the drilled hole by means of leads on one end of a pile-driving rig mounted on a ground supported vehicle, which rig has a counterbalance weight for the leads on its other end, reversing the rig end-for-end so as to juxtapose the other end of the rig adjacent to pile, applying a downward force to the pile until the same is seated home by means of a jack on said other end of the rig.

5. The method defined in claim 4, wherein the downward force on the pile is applied until the other end of the rig is lifted upwardly from its normal position with respect to the ground by upward forces reacting to the downwardly-applied forces, and then dropping the weight of the other end of the rig onto the pile.

6. Pile driving apparatus comprising, a rig on a ground-supported mobile chassis, said rig, including a crane having leads means on one end thereof for lofting a pile and for lowering the same into a hole in the ground, and a counterweight on the other end, jack means on said other end for applying a downward force to a pile, said jack means including an upright frame, extensible-retractable means for adjustably mounting a lower end of the frame on a lower portion of said rig, and extensible-retractable means for adjustably connecting an upper end of the frame to an upper portion of the rig for inward and outward adjustment whereby the lower and upper ends of the frame may be adjusted inwardly and outwardly with respect to the rig, and a hydraulic ram on the frame.

7. Apparatus as claimed in claim 6, said frame being comprised of a spaced pair of uprights, a first cross-head movably mounted between said uprights for adjustment between selected locations along the length thereof, a second cross-head slidably mounted between said uprights and below the first cross-head, means on the second cross-head for engaging the top of the pile, the hydraulic ram of said jack means being engaged between the cross heads.

8. Pile driving apparatus comprising, a rig on a ground-supported mobile chassis, said rig, including a crane having leads means on one end thereof for lofting a pile and for lowering the same into a hole in the ground, and a counterweight on the other end, jack means on said other end for applying a downward force to a pile, said jack means including an upright frame, means for adjustably mounting a lower end of the frame on a lower portion of said rig, extensible-retractable means for adjustably connecting an upper end of the frame to an upper portion of the rig for inward and outward adjustment whereby the upper end of the frame may be adjusted inwardly and outwardly with respect to the rig, and a hydraulic ram on the frame.

* * * * *